United States Patent [19]

Rickner

[11] Patent Number: 4,799,432

[45] Date of Patent: Jan. 24, 1989

[54] AUXILIARY TOWEL RACK SHELVES

[76] Inventor: Thomas W. Rickner, 1107 Shamrock Dr., Dublin, Ga. 32121

[21] Appl. No.: 617,191

[22] Filed: Jun. 4, 1984

[51] Int. Cl.[4] ..... A47B 23/00

[52] U.S. Cl. ..... 211/105.1; 108/42; 248/214

[58] Field of Search ..... 108/152, 42; 211/105.1, 211/105.2, 16, 87, 88, 90; 312/224, 342, 445; 248/214, 205.1, 220.4, 220.2, 489, 498; D6/567, 570, 574

[56] References Cited

U.S. PATENT DOCUMENTS

| | | | |
|---|---|---|---|
| D. 219,988 | 2/1971 | Willis | D6/570 |
| 577,204 | 2/1897 | Patten | 312/213 |
| 2,127,967 | 8/1938 | Thomas | 108/42 X |
| 2,612,273 | 3/1947 | Smith | 211/86 |
| 2,957,587 | 4/1957 | Tobin | 108/27 |
| 3,233,744 | 2/1966 | Ripps | 248/214 X |
| 4,165,852 | 8/1979 | Chervenak | 108/152 X |
| 4,181,382 | 1/1980 | Harvey | 248/214 X |
| 4,233,911 | 11/1980 | Vignale | 108/30 |
| 4,372,449 | 2/1983 | Fink | 248/214 X |

*Primary Examiner*—James T. McCall

*Attorney, Agent, or Firm*—Dowell & Dowell

[57] ABSTRACT

Auxiliary shelves are mounted between side members having a lower portion that extends below and behind a towel rack and engages the wall so that the assembly can be easily mounted within the towel rack and provide stable support for articles on the shelves.

6 Claims, 1 Drawing Sheet

AUXILIARY TOWEL RACK SHELVES

BACKGROUND OF THE INVENTION

1. Field of the Invention

This invention relates to shelf structure and more particularly to auxiliary shelves which provide supplemental storage space in a bathroom including a shower enclosure.

2. Description of the Prior Art

An auxiliary rack which is mounted on a towel bar is disclosed in Smith U.S. Pat. No. 2,612,273. This provides for spring members to engage the towel bar, thereby presenting the possibility of inadvertent dislodgement.

Vignale U.S. Pat. No. 4,233,911 discloses a shelf that is supported directly on a towel bar.

Harvey U.S. Pat. No. 4,181,382 discloses a double shelf cabinet that is mounted by spring brackets on a towel bar.

Tobin U.S. Pat. No. 2,957,587 discloses a shelf that is mounted on the wall of a shower stall.

Patten U.S. Pat. No. 577,204 discloses a wall cabinet having an upper shelf portion mounted on the wall by tapering support members

SUMMARY OF THE INVENTION

The invention provides a pair of parallel support members that carry one or more shelves in their upper portion and have lower portions of reduced width which slide behind the bar of a towel rack, the rear edges of the support members engaging the wall to provide firm support, the structure not only providing auxiliary shelf space, but permitting ordinary use of the towel rack itself.

DESCRIPTION OF THE DRAWING

An embodiment of the invention is represented in the drawing in which.

DESCRIPTION OF THE PREFERRED EMBODIMENT

Figure 1:
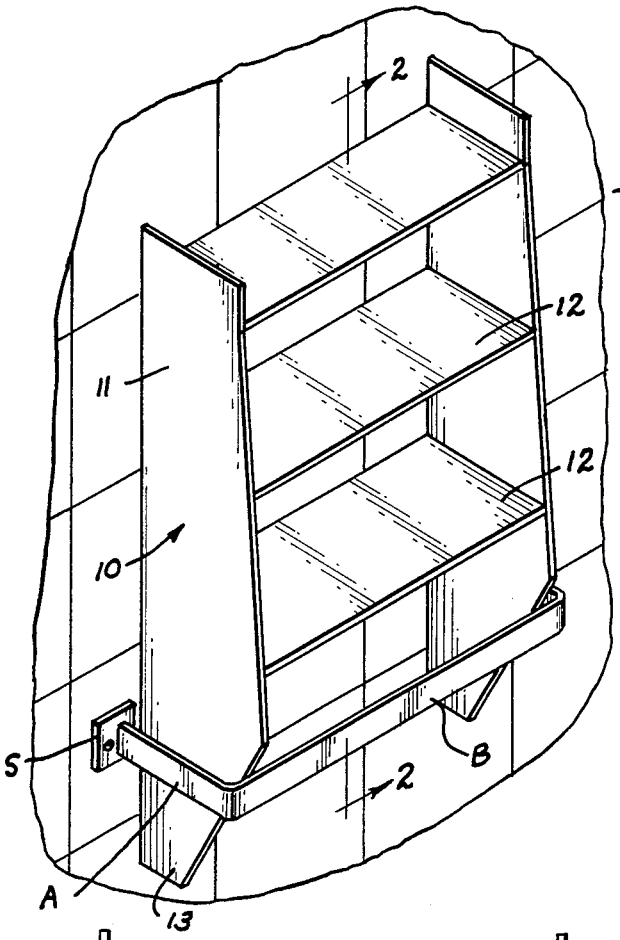
FIG. 1 is a perspective illustrating the auxiliary shelf structure mounted within a conventional towel rack.

With further reference to the drawing there is illustrated a conventional towel rack including spaced horizontal arms A that are mounted by supports S on a wall surface W, and which includes a bar B extending between the side members and spaced outwardly from the wall.

Such structure is commonly used in bathrooms or enclosures for bathtubs and showers.

In order to provide auxiliary shelf space for various articles such as containers for products that are used in the bath the present invention includes a shelf assembly including parallel side members 10 having generally upper portions 11 for supporting one or more shelves 12 and lower leg portions 13 which are received within the confines of the rack and engage its bar at the upper portions of the leg portions.

The parallel side members have a rear edge 14 that engages the wall, at least below the level of the bar B. They also have a front edge 15 that may taper from a lesser width at its upper extremity 16 to a greater width at the lower extremity 17 of the upper portion 11, and an edge 18 of the leg portion 13 that tapers downwardly and inwardly to a minimum width at its lowermost extremity 20.

The width of the lower part of the leg portion 13 is such that it can be received between the bar B and the wall so that the assembly may be slid downwardly within the confines of the rack until the front edges 18 engage the bar. In such position the assembly is stabilized by wedging action and supported by engagement with the bar and the wall. Hence, any tendency of the upper portion to fall outwardly is resisted by engagement of the front edges 18 with the bar and the rear edges 14 of the side members with the wall surface below the level of the rack.

Additional stability may be provided by engagement between the outer sides of the side members and the inner sides of the arms of the rack, if the width of the assembly corresponds with the distance between the arms. However, such additional support is not necessary to provide stability for the assembly.

The assembly may be fabricated of suitable sheet materials such as plastic, wood, or metal. Alternatively, the side members may be of framing construction.

The assembly may be fashioned of a size to be received behind conventional towel bars so that it may be used without any structural modification of the existing towel rack, and may be easily placed in position and removed.

Figure 2:
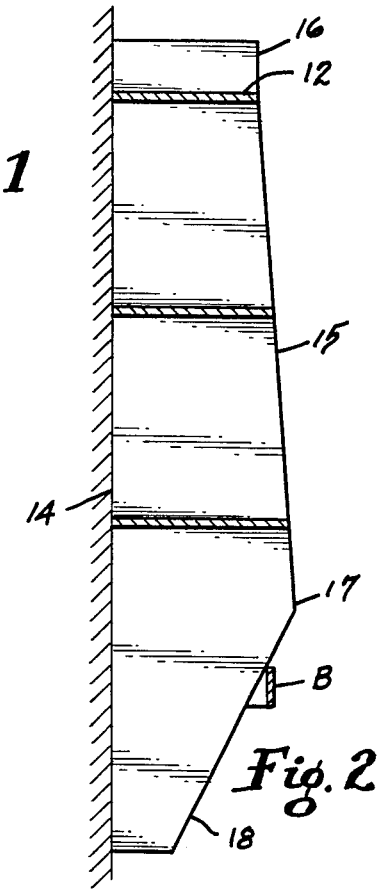
FIG. 2 is a section on line 2—2 of FIG. 1.
Figure 3:
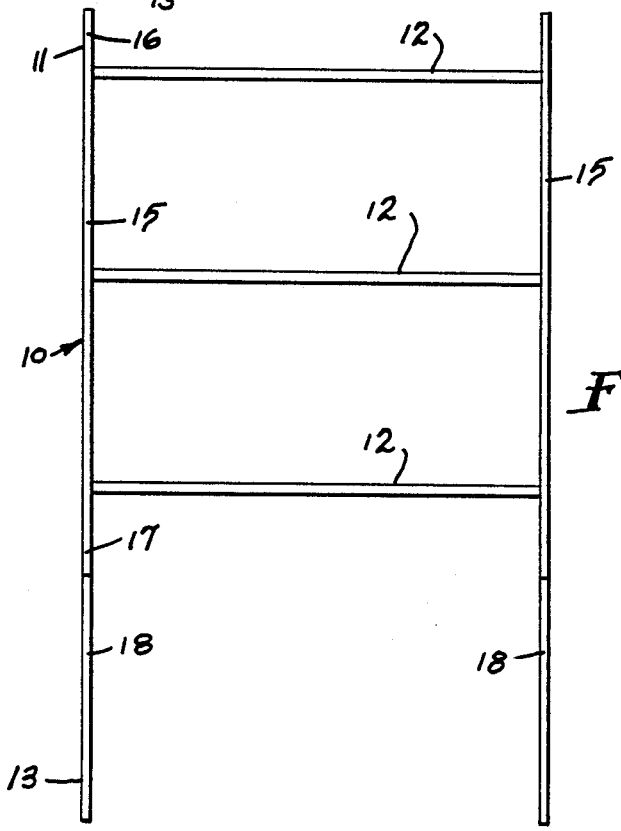
FIG. 3 is a front elevation.
Figure 4:
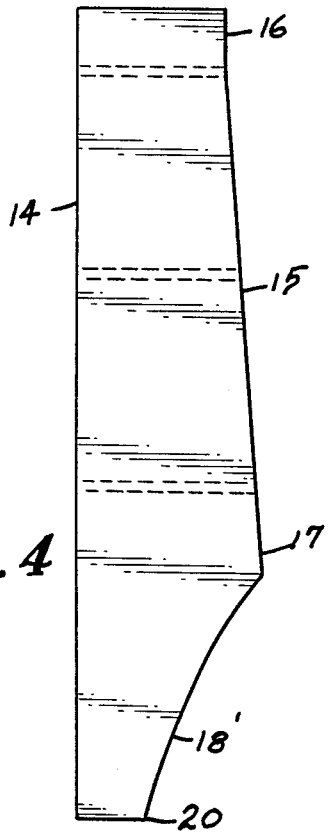
FIG. 4 is a side elevation of a modification.

In the modification of FIG. 4 the lower front edge 18' is curved inwardly instead of being straight as in FIGS. 1–3.

I claim:

1. A shelf assembly for use with and supportable within a wall mounted towel rack, said rack having spaced horizontal arms mounted on and extending outwardly from the wall and a bar extending between the arms and spaced outwardly from said wall, said shelf assembly comprising parallel side members providing an upper shelf supporting portion which is generally wider than the space between the bar and the wall, and a lower leg portion, the lower part of which is narrower than the space between the bar and the wall, received between the rack and the wall, one or more vertically spaced shelves extending between the side members of the upper shelf supporting portion, the lower leg portion of each side member having a rear edge portion abutting the wall below the horizontal plane of the bar when the assembly is received within the rack, the side members at the upper region of each leg portion having a front edge portion extending outwardly from the plane of said rear edge portion and said wall into engagement with said bar, whereby the assembly may be lowered into the towel rack until the front edge portion engages the bar and the rear edge portion engages the wall, thereby securing the assembly within said rack.

2. The invention of claim 1, in which the lower leg portion of each side member tapers outwardly, upwardly, from a reduced width at its lowermost extremity to a wedging engagement with said bar.

3. The invention of claim 1 in which the side members have a maximum width adjacent to their contact with the bar and taper to a lesser width as they extend upwardly above the bar.

4. The invention of claim 1 in which the leg portions are so spaced that they engage the inner sides of the arms of the rack.

5. The invention of claim 1 in which the side members are formed of sheet material.

6. The invention of claim 1 in which the rear edges of the parallel side members abut the wall above the horizontal plane of the bar.

* * * * *